US005746032A

United States Patent [19]

Koike et al.

[11] Patent Number: 5,746,032

[45] Date of Patent: May 5, 1998

[54] STRUCTURE FOR ATTACHING A LOWER TRANSVERSE FRAME MEMBER OF A SASH TO A LOWER EDGE OF A BUILDING OPENING

[75] Inventors: Sou Koike; Masao Hirano, both of Toyama-ken; Takayuki Okubo, Kagawa-ken, all of Japan

[73] Assignee: YKK Architectural Products Inc., Tokyo, Japan

[21] Appl. No.: 739,600

[22] Filed: Oct. 30, 1996

[30] Foreign Application Priority Data

Oct. 31, 1995 [JP] Japan ..... 7-283100

[51] Int. Cl.[6] ..... E06B 1/04

[52] U.S. Cl. ..... 52/204.1; 52/209; 52/235; 49/504

[58] Field of Search ..... 52/209, 235, 204.1; 49/504

[56] References Cited

U.S. PATENT DOCUMENTS

| | | | |
|---|---|---|---|
| 3,410,027 | 11/1968 | Bates | 52/209 X |
| 3,638,372 | 2/1972 | Rosenthal | 52/209 X |
| 3,774,360 | 11/1973 | Hubbard et al. . | |
| 4,006,562 | 2/1977 | Belanger et al. . | |
| 4,229,905 | 10/1980 | Rush | 52/209 X |
| 4,259,813 | 4/1981 | Winner et al. . | |
| 4,310,991 | 1/1982 | Seely . | |
| 4,691,487 | 9/1987 | Kessler | 52/209 |
| 4,715,152 | 12/1987 | Tanikawa . | |
| 4,819,405 | 4/1989 | Jackson | 52/209 X |
| 4,831,779 | 5/1989 | Kehrli et al. . | |
| 5,018,307 | 5/1991 | Burrous et al. . | |
| 5,067,279 | 11/1991 | Hagemeyer . | |
| 5,095,672 | 3/1992 | Tanikawa . | |
| 5,179,804 | 1/1993 | Young . | |
| 5,283,977 | 2/1994 | Smith . | |
| 5,426,894 | 6/1995 | Headrick . | |

FOREIGN PATENT DOCUMENTS

| | | |
|---|---|---|
| 21 45 139 | 3/1973 | Germany . |
| 56-139779 | 10/1981 | Japan . |
| 2 128 666 | 5/1984 | United Kingdom . |
| WO 89/08765 | 9/1989 | WIPO . |

*Primary Examiner*—Christopher Kent

*Attorney, Agent, or Firm*—Finnegan, Henderson, Farabow, Garrett & Dunner, L.L.P.

[57] ABSTRACT

In a structure for attaching a lower transverse frame member of a sash in which an elongated attachment transverse member is attached to a lower edge portion of an opening of a building body and a lower transverse frame member constituting a sash frame is attached to said attachment transverse member, the attachment transverse member has a hollow structure formed on the outdoor side portion thereof, and the hollow structure has a drain port opening to the outdoor side. Each of fixing members for fixing the lower transverse frame member to the attachment transverse member is so arranged that the front end thereof projects into the hollow structure.

5 Claims, 6 Drawing Sheets

STRUCTURE FOR ATTACHING A LOWER TRANSVERSE FRAME MEMBER OF A SASH TO A LOWER EDGE OF A BUILDING OPENING

BACKGROUND OF THE INVENTION

The present invention relates to a structure for attaching a lower transverse frame member of a sash to a building body, particularly for such lower transverse frame member as constituting a sash frame of a storefront sash which is installed at the front of a building of a shop, a store or the like.

Generally, a sash is constructed by mounting glasses, doors or the like in a sash frame. The sash frame is constructed by connecting an upper transverse frame member, a lower transverse frame member and bilateral vertical frame members. The sash is installed in the opening of the building body by fixing the upper transverse frame member to the upper edge portion of the opening by means of fixing members and fixing the lower transverse frame member to the lower edge portion of the opening by means of screws.

When the sash is installed as described above, it may happen that the rain water dropping through the holes through which the screws for fixing the lower transverse frame member to the lower edge portion of the opening are inserted and fastened flows downward beneath the lower transverse frame member and penetrates the building body through the lower edge portion of the opening. Further, the rain water flowing through the connecting portions between the lower transverse frame member and each of the vertical frame members may also flow downward beneath the lower transverse frame member and penetrates the building body through the lower edge portion of the opening.

In a known structure considering the above mentioned problem, an attachment transverse member is attached to the lower edge portion of the opening of the building body, and the lower transverse frame member is fixed to this attachment transverse member by means of screws. In this structure, the rain water dropping through the holes through which the screws for fixing the lower transverse frame member are inserted and fastened and/or flowing through the connecting portions between the lower transverse frame member and each of the vertical frame members drops onto the attachment transverse member, and then it is drained along the attachment transverse member.

However, even in this improved structure, it may happen that the rain water dropping on the attachment transverse member flows further downward beneath the attachment transverse member through the portion to which the screws for fixing the lower transverse frame member to the attachment transverse member are fastened, and penetrates the building body through the lower edge portion of the opening.

SUMMARY OF THE INVENTION

An object of the present invention is to substantially eliminate defects or drawbacks encountered in the prior art described above and to provide a structure for attaching a lower transverse frame member of a sash in which the rain water dropping on an attachment transverse member attached to a lower edge portion of an opening of a building body is prevented from penetrating the building body through the lower edge portion of the opening thereof.

This and other objects of the present invention can be achieved by a structure for attaching a lower transverse frame member of a sash in which an elongated attachment transverse member is attached to a lower edge portion of an opening of a building body and a lower transverse frame member constituting a sash frame is attached to the attachment transverse member, wherein the attachment transverse member has a hollow structure formed on the outdoor side portion thereof, the hollow structure has a drain port opening to the outdoor side, and each of fixing members for fixing the lower transverse frame member to the attachment transverse member is so arranged that the front end thereof projects into the hollow structure.

In a preferred embodiment, the attachment transverse member has an inflow port opening into the hollow structure.

In the structure according to the present invention, since the front end of the fixing member used for fixing the lower transverse frame member to the attachment transverse member is arranged to project into the hollow structure formed to the attachment transverse member, the rain water dropping on the attachment transverse member flows into the hollow structure through the portion to which the fixing member is fastened, and then it is drained from the hollow structure through the drain port formed thereto. Therefore, it can not happen that the rain water dropping on the attachment transverse member flows further downward beneath the attachment transverse member through the portion to which the fixing member for fixing the lower transverse frame member to the attachment transverse member is fastened, and penetrates the building body through the lower edge portion of the opening thereof.

Further, in the structure having the inflow port opening into the hollow structure, the rain water dropping on the attachment transverse member smoothly flows into the hollow structure through the inflow port. Therefore, the drainage goes on smoothly.

The nature and further features of the present invention will be made clearer from the following description made with reference to the accompanying drawings.

DESCRIPTION OF THE PREFERRED EMBODIMENTS

Figure 1:
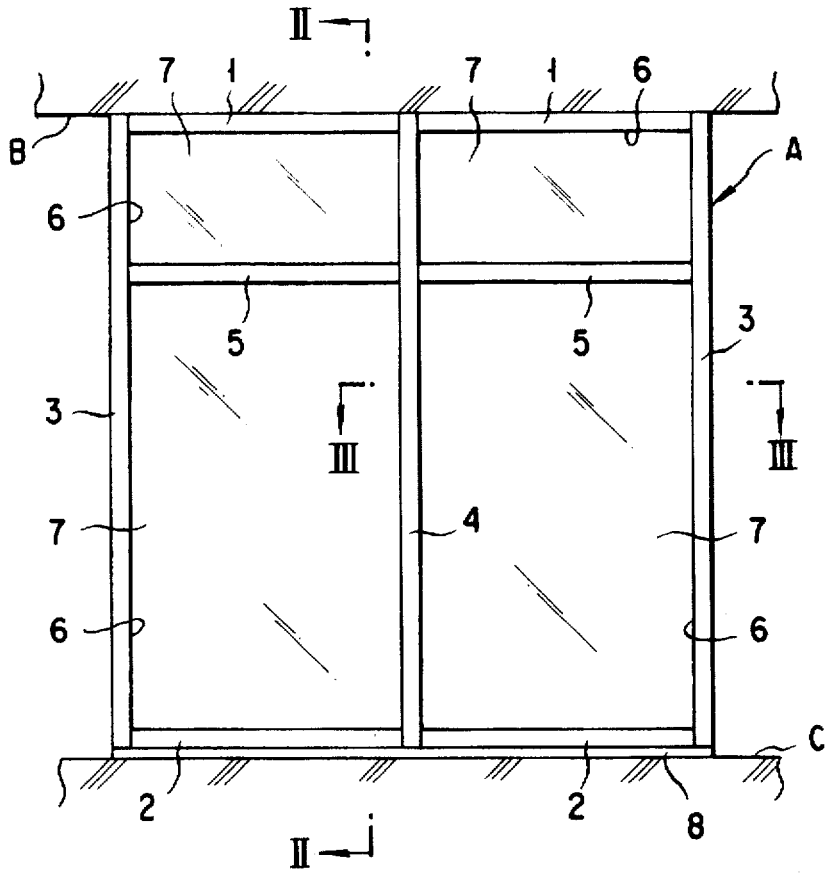
FIG. 1 is an illustrated front view showing an entire structure of a sash according to an embodiment of the present invention.

As shown in FIG. 1, an upper transverse frame member 1, a lower transverse frame member 2, bilateral, i.e., left and right vertical frame members 3, an intermediate vertical frame member 4 and an intermediate transverse frame member 5 are assembled to form a sash frame A. In detail, the upper transverse frame member 1, the intermediate transverse frame member 5 and the lower transverse frame member 2 are extended between and connected with one of the vertical frame members 3 and the intermediate vertical frame member 4, and the upper transverse frame member 1, the intermediate transverse frame member 5 and the lower transverse frame member 2 are extended between and connected with the same intermediate vertical frame member 4 and the other vertical frame member 3, thereby constituting the sash frame A.

The sash frame A comprises opened frame sections 6 for attachment of glasses 7 at its bilateral upper and lower portions and is used to constitute a sash, for example, a storefront sash.

The above-mentioned sash is installed to an opening of a building body. For example, the upper transverse frame member 1 is attached to the upper edge portion B of the opening, an attachment transverse member 8 is attached to the lower edge portion C of the opening, and the lower transverse frame member 2 is attached to the attachment transverse member 8.

The attachment transverse member 8 is an elongated member extending from one of the vertical frame members 3 to the other vertical frame member 3, and is provided to receive rain water flowing, for example, through connecting portions between the lower transverse frame member 2 and each of the vertical frame members 3 and the intermediate vertical frame member 4 to thereby prevent the rain water from flowing to the lower edge portion C of the opening.

Figure 2:
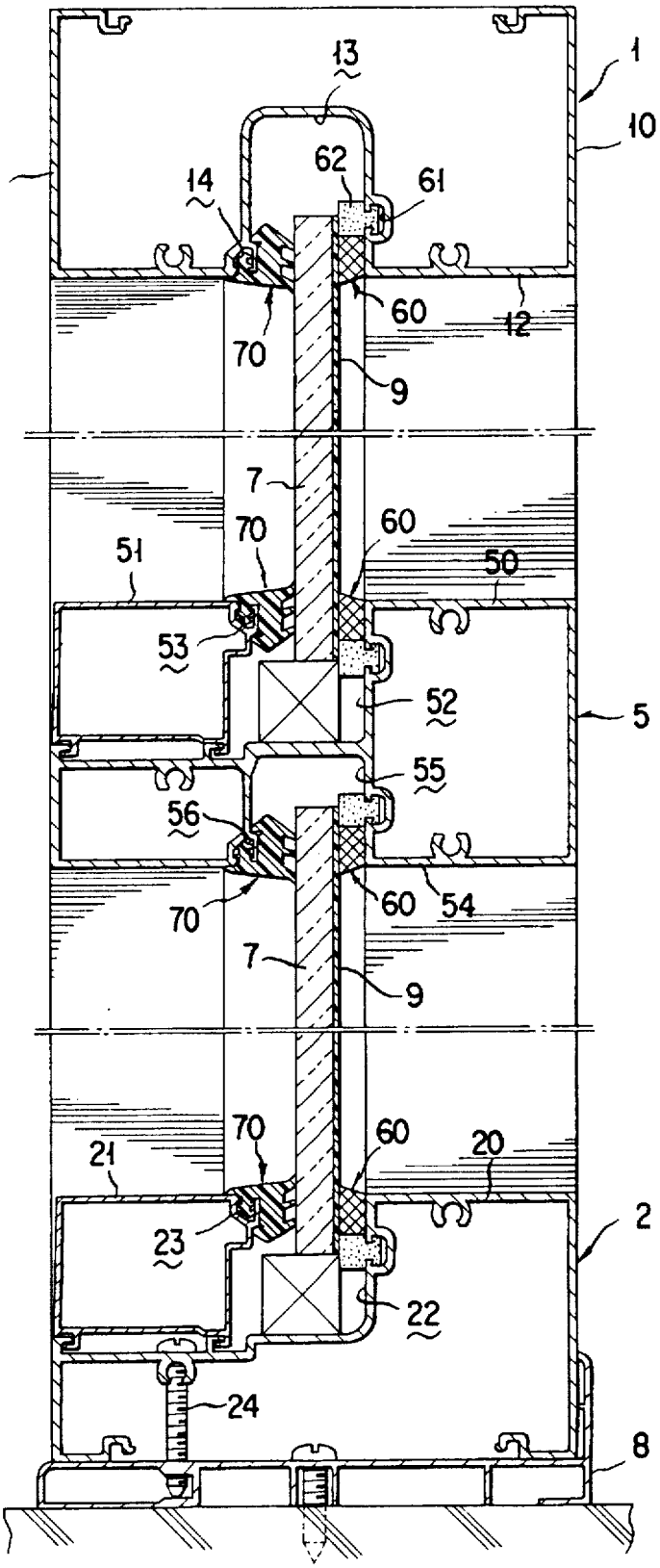
FIG. 2 is a sectional view taken along the line II—II in FIG. 1.

As shown in FIG. 2, a scattering preventing film 9 made of polyester film or the like is applied through heat fusing process to the indoor side surface of the glass 7. By the scattering preventing film 9, the glass 7 is prevented from being separated and scattered in pieces even if a certain object is blown off by a strong wind and collides with and cracks or breaks the glass 7.

As shown in FIG. 2, the upper transverse frame member 1 is composed of an indoor side vertical plate member 10, an outdoor side vertical plate member 11 and a connecting plate member 12 and has substantially an upward opening C-shape in section. The connecting plate member 12 is provided with an inward opening glass attachment channel 13 and an inward opening seal member fitting groove 14 adjacent to the glass attachment channel 13. (Here and hereinafter, the word "inward" shall mean the direction directed to the inside of the opened frame section 6.)

The lower transverse frame member 2 is formed by attaching a bead member 21 to a body frame member 20 so as to have an inward opening glass attachment channel 22. The bead member 21 is formed with an inward opening seal member fitting groove 23. The body frame member 20 is connected to the attachment transverse member 8 by means of screws 24.

Figure 3:
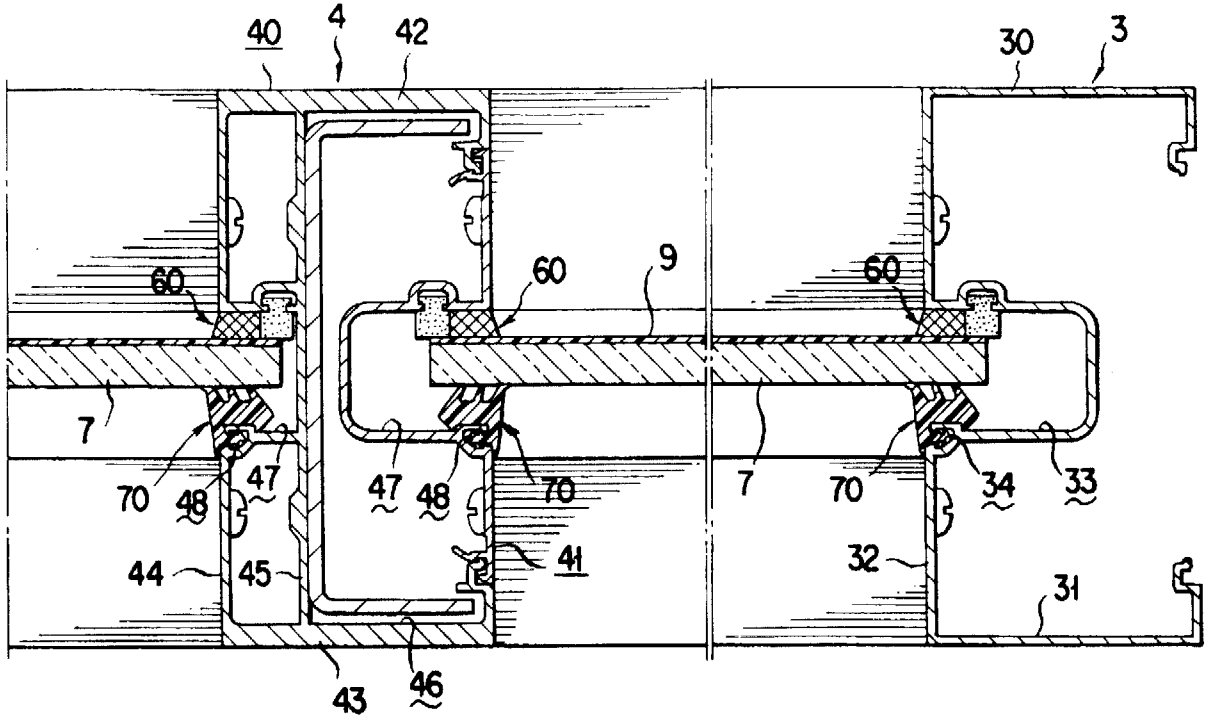
FIG. 3 is a sectional view taken along the line III—III in FIG. 1.

As shown in FIG. 3, the vertical frame member 3 is composed of an indoor side vertical plate member 30, an outdoor side vertical plate member 31 and a connecting plate member 32 and has substantially an outward opening C-shape in section. (Here and hereinafter, the word "outward" shall mean the direction directed to the outside of the opened frame section 6.) The connecting plate member 32 is provided with an inward opening glass attachment channel 33 and a seal member fitting groove 34 adjacent to the glass attachment channel 33.

The intermediate vertical frame member 4 is formed by connecting an auxiliary frame member 41 to a body frame member 40. The body frame member 40 is composed of an indoor side vertical plate member 42, an outdoor side vertical plate member 43, an end connecting plate member 44 and an intermediate connecting plate member 45, and has substantially a C-shape in section provided with an auxiliary frame member attachment recess 46. The end connecting plate member 44 and the auxiliary frame member 41 are respectively formed with an inward opening glass attachment channel 47 and a seal member fitting groove 48 adjacent to the glass attachment channel 47.

As shown in FIG. 2, the intermediate transverse frame member 5 is formed by attaching an bead member 51 to an body frame member 50 so as to have an inward opening glass attachment channel 52. The bead member 51 is formed with an upward opening seal member fitting groove 53. The lower transverse plate member 54 of the body frame member 50 is formed with an inward opening glass attachment channel 55 and an inward opening seal member fitting groove 56 adjacent to the glass attachment channel 55.

From the respective structures mentioned above, it follows that the glass attachment channels and the seal member fitting grooves are formed on the inner surface of each opened frame section 6 of the sash frame A continuously along the four peripheral sides of the opened frame section 6. The glass 7 is inserted in the glass attachment channels and supported by indoor side seal members 60 and outdoor side seal members 70.

A structure for attaching the lower transverse frame member 2 to the lower edge portion C of the opening of the building body will be described hereunder.

Figure 4:
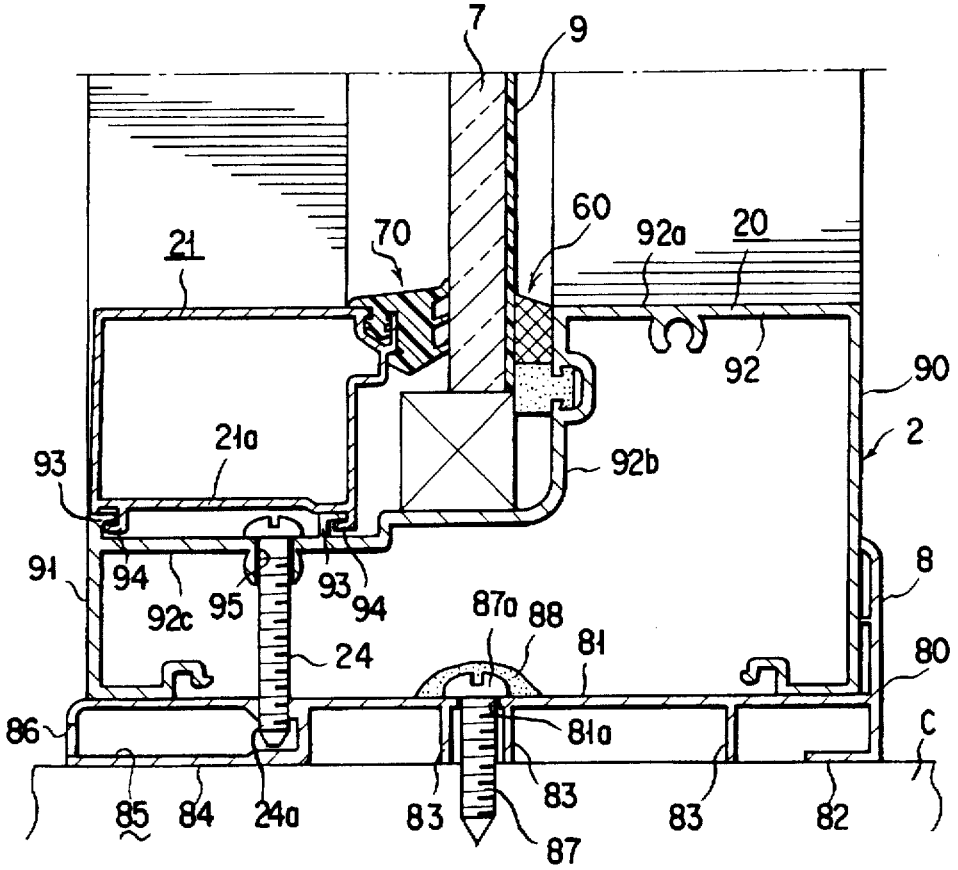
FIG. 4 is an enlarged sectional view showing a structure for attaching a lower transverse frame member according to a first embodiment of the present invention.

FIG. 4 shows a first embodiment of the present invention. The attachment transverse member 8 comprises an indoor side vertical plate member 80 and a transverse plate member 81 integrally formed with the indoor side vertical plate member 80. A support transverse piece 82 is integrally formed to the lower end portion of the indoor side vertical plate member 80. A plurality of support leg pieces 83 are integrally formed to the lower surface of the transverse plate member 81 to project downward. Further, an upward opening C-shaped piece 84 is also integrally formed to the lower surface of the transverse plate member 81 at the outdoor side portion thereof so as to project downward and constitute a hollow structure 85. A drain port 86 is formed at the outdoor side vertical portion of the C-shaped piece 84.

The body frame member 20 of the lower transverse frame member 2 is composed of an indoor side vertical plate member 90, an outdoor side vertical plate member 91 and a connecting plate member 92 and has substantially a downward opening C-shape in section. The connecting plate member 92 is composed of an indoor side transverse piece 92*a*, an intermediate vertical piece 92*b* and an outdoor side transverse piece 92*c* and has substantially a crank-like shape in section. A pair of engage-receiving pieces 93 are integrally formed to the outdoor side transverse piece 92*c*.

The bead member 21 has a hollow structure which is rectangular in section. A pair of engaging pieces 94 are integrally formed to the lower transverse plate member 21*a* of the bead member 21. The bead member 21 is attached to the outdoor side transverse piece 92*c* of the body frame member 20 by engaging the engaging pieces 94 with the engage-receiving pieces 93 in the manner that a space is left between the outdoor side transverse piece 92*c* and the lower transverse plate member 21*a*.

The transverse plate member 81 of the attachment transverse member 8 is fixed to the lower edge portion C of the opening of the building body by means of fixing members 87 such as screws at the indoor side relative to the hollow structure 85, and thereby the support transverse piece 82, the support leg pieces 83 and the upward opening C-shaped piece 84 are pressed onto the lower edge portion C. Thus, the attachment transverse member 8 is attached to the lower edge portion C of the opening of the building body. The head portion 87*a* of the fixing member 87 resting on the transverse plate member 81 is covered with caulking material 88 so as to prevent the rain water from flowing downward beneath the transverse plate member 81 through a hole 81*a*through which the fixing means 87 is inserted.

The fixing member 24 such as a screw for fixing the body frame member 20 to the attachment transverse member 8 is inserted through a hole 95 formed to the outdoor side transverse piece 92*c* of the connecting plate 92 of the body frame member 20 at an intermediate portion between the pair of engage-receiving pieces 93 and fastened to the transverse plate member 81 of the attachment transverse member 8. The front end 24*a* of the fixing member 24 projects into the hollow structure 85.

In this structure, the rain water dropping through the hole 95 through which the fixing member 24 for fixing the body frame member 20 to the attachment transverse member 8 is inserted flows into the hollow structure 85 through the portion to which the fixing member 24 is fastened, and then it is drained through the drain port 86. Further, the rain water flowing downward through the connecting portions between the lower transverse frame member 2 and each of the vertical frame members 3 and the intermediate vertical frame member 4 flows along the transverse plate member 81 of the attachment transverse member 80 and then flows into the hollow structure 85 through the portion to which the fixing member 24 is fastened, and then it is drained through the drain port 86.

Figure 5:
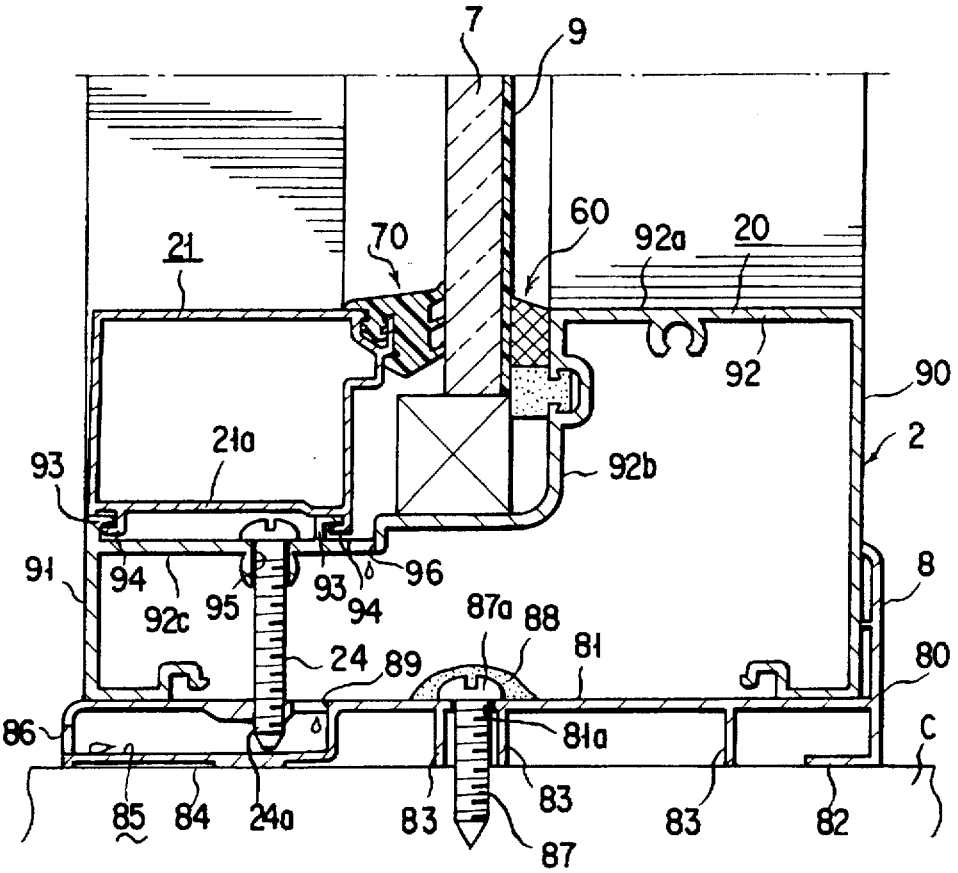
FIG. 5 is a sectional view showing a structure for attaching a lower transverse frame member according to a second embodiment of the present invention.

A second embodiment of the present invention will be described hereunder with reference to FIG. 5, in which like reference numerals are added to portions or members corresponding to those of the first embodiment and the explanations thereof are omitted.

A inflow port 89 opening into the hollow structure 85 is formed to the transverse plate member 81 of the attachment transverse member 8, and a drain hole 96 is formed to the outdoor side transverse piece 92*c* of the connecting plate member 92 of the body frame member 20.

In this structure, the rain water dropping on the attachment transverse member 8 smoothly flows into the hollow structure 85 through the inflow port 89, and then it is drained from the drain port 86. Further, the rain water penetrating the sealing portion where the glass is sealed by the outdoor side seal member 70 drops through the drain hole 96 onto the attachment transverse member 8, then smoothly flows into the hollow structure 85 through the inflow port 89, and then it is drained from the drain port 86. Thus, in this structure, drainage goes on smoothly.

In the above described first and second embodiments, both longitudinal end openings of the hollow structure 85 are closed by end cover members or sealing members so that the rain water flowing into the hollow structure 85 may not flow out through the longitudinal end portions thereof.

Figure 6:
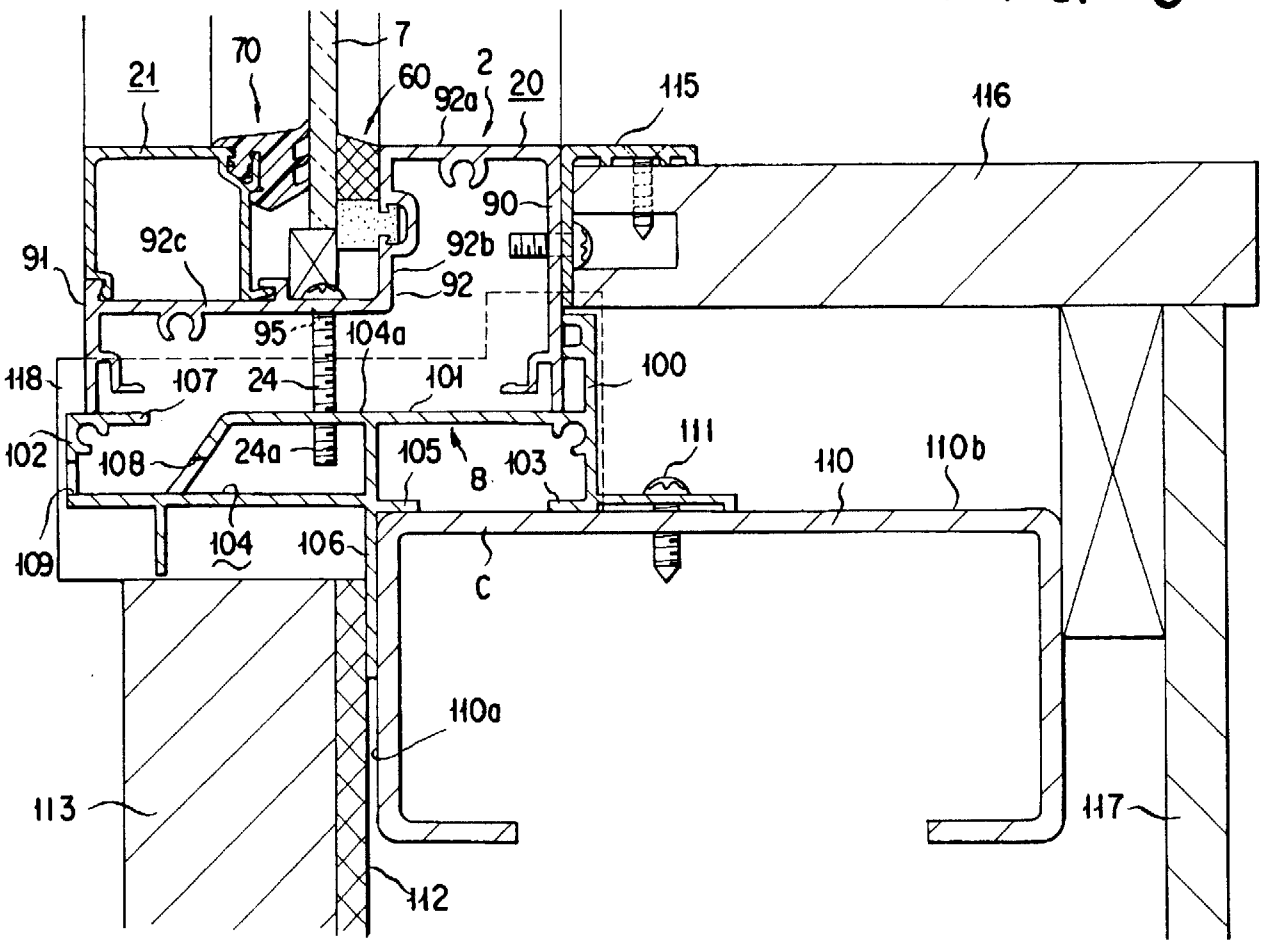
FIG. 6 is a sectional view showing a structure for attaching a lower transverse frame member according to a third embodiment of the present invention.

A third embodiment of the present invention will be further described hereunder with reference to FIG. 6.

The attachment transverse member 8 comprises an indoor side vertical plate member 100, a transverse plate member 101 integrally formed with the indoor side vertical plate member 100 and an outdoor side vertical plate member 102. An attachment transverse piece 103 is integrally formed to the lower end portion of the indoor side vertical plate member 100. A hollow structure 104 is integrally formed to the lower surface of the transverse plate member 101 at the outdoor side portion thereof. A support transverse piece 105 and a support vertical piece 106 are formed integrally to the indoor side lower end portion of the hollow structure 104 to project transversely to the indoor side and to extend vertically downward, respectively. A support piece 107 for supporting the lower transverse frame member 2 is integrally formed to the outdoor side vertical plate member 102, and the outdoor side vertical plate member 91 of the body frame element 20 of the lower transverse frame member 2 is made to abut against the support piece 107.

A fixing member 24 for fixing the body frame member 20 of the lower transverse frame member 2 to the attachment transverse member 8 is inserted through a hole 95 formed to the outdoor side transverse piece 92*c* of the connecting plate member 92 of the body frame member 20 and fastened to the transverse plate member 101 of the attachment transverse member 8. The front end 24*a* of the fixing member 24 projects into the hollow structure 104.

In this structure, the rain water dropping through the hole 95 through which the fixing member 24 for fixing the body frame member 20 to the attachment transverse member 8 is inserted flows into the hollow structure 104 through the portion to which the fixing member 24 is fastened, then flows out from a drain port 108 formed to the hollow structure 104, and then it is drained through a drain port 109 formed to the outdoor side vertical plate member 102 to the outside. The rain water flowing downward through the connecting portions between the lower transverse frame member 2 and each of the vertical frame members 3 and the intermediate frame member 4 is also drained to the outside in the same way.

Since the upper surface 104*a* of the hollow structure 104 is at a level higher than the level of the drain port 109, a part of the rain water dropping on the attachment transverse member 8 flows from the upper surface 104*a* of the hollow structure 104 directly to the drain port 109 instead of flowing into the hollow structure 104, and then it is drained through the drain port 109 to the outside.

The lower edge portion C of the opening of the building body is formed of a C-shaped channel member 110. The vertical piece 106 of the attachment transverse member 8 is made to abut against the outdoor side vertical surface 110*a* of the channel member 110, and the attachment transverse piece 103 of the attachment transverse member 8 is fixed to the upper surface 110*b* of the channel member 110 by means of fixing members 111 such as screws. An exterior member 113 is attached to the vertical surface 110*a* of the channel member 110 with a seal member 112 interposed therebetween.

Reference numeral 115 denotes an attachment member for attaching an interior member, and reference numerals 116 and 117 denote interior members, respectively. The longitudinal end portions of the attachment transverse member 8 are covered with end cover members 118 so that the rain water flowing into the hollow structure 104 may not flow out through the longitudinal end portions thereof.

In the respective embodiments described above, the attachment transverse member 8 is fixed to the lower edge portion of the opening of the building body by means of fixing members 87 or 111. The attachment transverse member 8 may be alternatively fixed by means of anchors or may be fixed by concrete. In each case, the rain water dropping on the attachment transverse member 8 does not flow downward to the lower edge portion of the opening of the building body.

What is claimed is:

1. A structure for attaching a lower transverse frame member of a sash to a lower edge portion of an opening of a building, the structure comprising:

an elongated attachment transverse member insertable between the lower transverse frame member and the lower edge portion of the opening, having a base plate defining an indoor side and an outdoor side of said base plate and an enclosed hollow portion formed only on the outdoor side below said base plate, said enclosed hollow portion having a drain port opening to the outdoor side, and a fixing member for fixing the lower transverse frame member to said attachment transverse member, arranged to project through an aperture in the base plate and into said enclosed hollow portion, such that water in the lower transverse frame member flows through the aperture into the enclosed hollow portion and out the drain port;

said attachment transverse member including an indoor side vertical plate member provided with a support transverse piece integrally formed to said base plate, and said base plate including a plurality of support leg pieces integrally formed to a lower surface thereof to project downward, said hollow enclosed portion being formed by an upwardly opening generally C-shaped piece integrally formed on a lower surface of said base plate at the outdoor side, said attachment transverse member being adapted to be attached to the lower edge portion of said opening of the building by said support transverse piece, said support leg pieces and said upwardly opening generally C-shaped piece;

said base plate being adapted to be fixed to the lower edge portion of the opening of the said enclosed hollow portion, and a head of said fixing member being covered with building with a fixing member at a position spaced toward the indoor side relative to caulking material.

2. A structure for attaching a lower transverse frame member of a sash according to claim 1, wherein said base plate includes an inflow port opening into said enclosed hollow portion.

3. A structure for attaching a lower transverse frame member of a sash according to claim 1, further including end members for closing longitudinal end portions of said enclosed hollow portion.

4. A structure for attaching a lower transverse frame member of a sash according to claim 1, wherein said attachment transverse frame member further includes an indoor side vertical plate member provided with an attachment transverse piece integrally formed to said base plate, said base plate being further integrally formed with an outdoor side vertical plate member, said enclosed hollow portion being integrally formed to the lower surface of said base plate at the outdoor side, said enclosed hollow portion being provided with a support transverse piece and a support vertical piece integrally formed to an indoor side lower end portion thereof to project transversely to the indoor side and vertically downward, respectively, said outdoor side vertical plate member having a drain port formed at a level lower than a level of said base plate, and said attachment transverse member for attaching to the lower edge portion of the opening of the building with said attachment transverse piece and said support transverse piece in contact with an upper surface of the lower edge portion and said support vertical piece in contact with an outdoor side vertical surface of the lower edge portion.

5. A structure for attaching a lower transverse frame member of a sash according to claim 1, wherein end cover members are attached to longitudinal end portions of said attachment transverse member.

* * * * *

UNITED STATES PATENT AND TRADEMARK OFFICE

CERTIFICATE OF CORRECTION

PATENT NO. : 5,746,032
DATED : May 5, 1998
INVENTOR(S) : Koike et al.

It is certified that error appears in the above-identified patent and that said Letters Patent is hereby corrected as shown below:

Claim 1, column 7, line 32, after "opening of the", insert --building with a fixing member at a position spaced toward the indoor side relative to--.

Claim 1, column 7, line 34, after "with" (first occurrence), delete "building with a fixing member at a position spaced toward the indoor side relative to".

Signed and Sealed this

Ninth Day of March, 1999

*Attest:*

Q. TODD DICKINSON

*Attesting Officer*

*Acting Commissioner of Patents and Trademarks*